US005322285A

United States Patent [19]

Turner

[11] Patent Number: 5,322,285

[45] Date of Patent: Jun. 21, 1994

[54] GOLF PUTTER

[76] Inventor: Terry S. Turner, 3316 Industry Dr., Long Beach, Calif. 90806

[21] Appl. No.: 980,458

[22] Filed: Nov. 23, 1992

[51] Int. Cl.[5] ..... A63B 53/00; A63B 53/12

[52] U.S. Cl. ..... 273/164.1; 273/80 R; 273/81 R; 273/175; 273/167 J; 273/167 R

[58] Field of Search ..... 273/80 R, 80 B, 81 R, 273/167-175, 77 R, 77 A, 193 R, 194 R, 67 R, DIG. 23, 80.1-80.8, 164.1

[56] References Cited

U.S. PATENT DOCUMENTS

| | | | |
|---|---|---|---|
| 1,573,708 | 2/1926 | Hoerle | 273/80.8 X |
| 1,662,712 | 3/1928 | Mensing | 273/80 B |
| 1,670,530 | 5/1928 | Cowdery | 273/80 B |
| 1,680,447 | 8/1928 | Bryant | 273/80 R |
| 1,854,548 | 4/1932 | Hunt | 273/78 |
| 1,890,037 | 12/1932 | Johnson | 273/80 R |
| 1,901,562 | 3/1933 | Main | 273/173 |
| 1,917,795 | 7/1933 | Fetter | 273/80 R |
| 1,983,158 | 12/1934 | Young | 273/80.8 X |
| 3,143,349 | 8/1964 | MacIntyre | 273/167 R X |
| 3,231,281 | 1/1966 | Wallo | 273/193 A |
| 3,556,532 | 1/1971 | Ballmer | 273/167 H |
| 3,652,093 | 3/1972 | Reuter | 273/167 F |
| 3,989,257 | 11/1976 | Barr | 273/167 J X |
| 4,121,832 | 10/1978 | Ebbing | 273/171 |
| 4,162,074 | 7/1979 | Thomson | 273/175 |
| 4,163,554 | 8/1979 | Bernhardt | 273/80 C |
| 4,174,839 | 11/1979 | Marrs | 273/164.1 X |
| 4,343,472 | 8/1982 | Hamilton | 273/171 X |
| 4,484,746 | 11/1984 | Brill | 273/167 A |
| 4,741,535 | 5/1988 | Leonhardt | 273/164.1 |
| 4,762,324 | 8/1988 | Anderson | 273/171 |
| 4,936,582 | 6/1990 | Bernstein | 273/80 B X |
| 4,954,198 | 9/1990 | Viellard | 273/80 R X |
| 5,080,365 | 1/1992 | Winchell | 273/169 |
| 5,094,454 | 3/1992 | Schering | 273/80 R X |
| 5,098,103 | 3/1992 | Mackeil | 273/175 |

FOREIGN PATENT DOCUMENTS

| | | | |
|---|---|---|---|
| 427717 | 4/1935 | United Kingdom | 273/80 R |
| 555027 | 7/1943 | United Kingdom | 273/80 R |
| 773162 | 4/1957 | United Kingdom | 273/80 R |
| 1201648 | 8/1970 | United Kingdom | 273/80 R |
| 2191706 | 12/1987 | United Kingdom | 273/175 |
| 2202319 | 9/1988 | United Kingdom | 273/81 R |

*Primary Examiner*—Vincent Millin
*Assistant Examiner*—Sebastiano Passaniti
*Attorney, Agent, or Firm*—L. Lee Humphries

[57] ABSTRACT

A golf putter has a hard grip or an all-metal grip, and the grip, shaft and head are formed of a single, stiff material, or materials having closely-related moduli of elasticity, into an integral structural element. It is cast, forged, bonded, or otherwise assembled, to achieve a stiff, but sensitive "feel", for the golfer. A low frequency "feel" and sound is obtained by the shaft being closed at both ends and by one or more sound chambers or resonating elements. No dissimilar materials are included between the "sweet spot" and the golfer's hands, including in the grip. In one embodiment, toe area loft of the head is greater than the center loft and the heel area loft is less than the center loft. The putter head toe area may be closed slightly and the heel area may be opened slightly. A bulge may be included in the heel or toe areas.

11 Claims, 8 Drawing Sheets

GOLF PUTTER

This invention is a golf putter, particularly one which is constructed to provide extraordinary "control", "feel" and sound to the user by having the grip, shaft and head integrated into a single, structural unit. Various additional features are included, in particular embodiments, to assist the golfer in his game, including a sound chamber, a specially-designed, compound face on the head of the putter and sight and alignment markings.

BACKGROUND OF THE INVENTION

A golf putter should provide "feel" to the golfer. That is, it should provide a feeling of precise control over the ball. A high vibration, if felt in the grip, or even heard, tends to destroy the feeling and psychology of control. The low frequencies give the solid "feel" to the putter and gives the golfer a reference, both as to feel and sound, to be sought in subsequent putts. Therefore, a putter should carry low frequencies to the grip, but not high frequencies. It is also desirable for the low frequencies but not the high frequencies to be heard, when the ball is hit correctly.

Each golf club has a "sweet spot" on the face of the head. The "sweet spot" is the point on the face of the head, in which the golf ball is best struck and which moves the ball in a straight direction. The "sweet spot" is located on the face of the head along a line passing through the center of inertia of the head. When a ball is struck at the "sweet spot", there is a solid "feel" to the strike and little or no torque is imparted to the club. Golfers test for the "sweet spot" on a putter by holding the face of the putter horizontally and dropping the ball on the face. They then listen for a "chuck", or low frequency, sound rather than a "ping", or high frequency, sound. The "chuck" sound denotes the "sweet spot". The "sweet spot" area is a general area around the "sweet spot" which, if the golfer hits within the "sweet spot" area, provides an acceptable golf shot. The "sweet spot area" may be approximately 2.5" in length, on, say, a face which is approximately 4 inches long. The best part of the "sweet spot" area, to hit the ball, is approximately one third the diameter of a golf ball in width, or 0.56", although striking within a width of 0.8" around the "sweet spot", will likely be quite an acceptable hit.

In putting, it is intended that the ball be struck on the "sweet spot" on the face of the putter, which is generally at or near the central area of the face. However, golfers do not always strike the ball within the "sweet spot" area of the club head and will sometimes, because of an inaccurate stroke, hit the ball outside the "sweet spot" area. If a putter is properly designed, as in the present invention, it can prevent disastrous results from an inaccurate stroke. In one of the embodiments, the putter provides some correction for inaccuracies of stroke.

Also, it is desirable on the putting green to give a gall backspin and lift. Various putters in the past have included angular or curved surfaces to provide overspin to the ball to help it roll forward in a straight line. U.S. Pat. No. 4,162,074 to William B. Thompson shows a bulge, or a convex surface, claimed to impart topspin, or overspin, to a golf ball.

SUMMARY OF INVENTION

The golf putter of the invention provides an extraordinary "feel" and low frequency sound which a golfer will expect and anticipate after having used the putter. The putter is a single, unitary construction throughout. In the preferred embodiment, it is "tuned" to allow lower frequencies to be transmitted to the user so that he feels and hears a "solid" touch and not a "ping" or a "tickle." In this regard, high frequencies are considered to be those above approximately 2500 cycles per minute and low frequencies are considered to be those below approximately 2500 cycles per minute. Frequencies as low as approximately 800 cycles per minute can be obtained in the putter, to be felt and heard by the golfer. Plugging the shaft at both ends and having a sound chamber in the head of the club enhance the low frequency "feel" and sound. This low frequency "feel" provides better control of the strike and is achieved by stiffness of the entire putter and an integral construction of the grip, shaft and head, of materials having the same or closely-related, high moduli of elasticity. There are no substantially dissimilar materials between the "sweet spot", where the ball is struck, and the golfer's hands. Thus, there are no discontinuities in the club, from face to grip, that mask, dampen or distort the strike of the ball. Prior art grips are often constructed of leather over a layer of rubber or paper which is glued or taped to the shaft. The shaft is often glued with epoxy or other adhesive to the putter head. Pratically all prior art putters are constructed of from five to thirteen different materials. Consequently, the "feel" of the prior art putter to the hands of the golfer is lessened considerably.

The portion of the putter of the invention between the golfer's hands, or gloves, and the "sweet spot" is constructed of a single material or of materials having closely-related moduli of elasticity. It is desired that the putter be very stiff. In the preferred embodiment, the putter grip, shaft and head are constructed of the same material and are formed into an integral unit. Materials having closely-related moduli of elasticity may be used provided they are formed into an integral, single structure. The material may be a pure metal, such as, but not limited to, titanium, aluminum, steel, stainless steel, magnesium, zinc, copper, bronze and brass or it may be alloys, mixtures or compounds thereof. Various other materials such as, but not limited to polymers, carbon, graphite, Kevlar, boron, and graphite boron may be used, provided they have sufficient stiffness. Ceramics may also be used. A preferred, economical material is low carbon steel. The modulus of elasticity in tension, for such steels is approximately 30,000,000 psi. Malleable cast iron is approximately 23,000,000 psi. Gray cast iron is approximately 15,000,000 psi. This range of modulus of elasticity is considered closely-related and would be suitable. The modulus of elasticity of wood, on the other hand, is 2,000,000 psi or below and, therefore, is not closely-related to that of the above metals. An explanation of modulus of elasticity and the above average values of modulus of elasticity in tension for low carbon steel, malleable cast iron, gray cast iron and wood are found on pages 20–22, in the textbook, Seely, *Resistance of Materials*, 1935, John Wiley & Sons, Inc., New York City, N.Y.. Page 21 describes the direct relationship of modulus of elasticity of a material to its stiffness. Page 85 of that work also illustrates the relationship between bending and the tensile unit stress. Shafts of suitable material, within the range of closely-related moduli of elasticity, are readily available in the commercial market.

In the preferred embodiment, the grip is of the same material as the shaft and the head, although it may be further treated, for better "feel" and for better control by the hands, by etching, bead blasting, splatter or other coating which does not involve a material tending to "cushion" to change the "feel" to the golfer.

The grip is constructed of one or more hard materials throughout. Ordinarily, such material will have a high modulus of elasticity, such as found in the low carbon steels and gray cast iron or higher. The Brinell hardness of annealed ingot iron, which would be suitable, is approximately 69. Low carbon, nickel, silicon steels and hardened stainless steels have Brinnell hardnesses which range approximately from 100 to 600, depending on how they are quenched or annealed. They are very suitable. It is desired that they be machinable. Such hard material is preferably one or more of the metals, polymers and other materials enumerated above. Such a grip never needs replacement. There is not deterioration of a grip constructed of such hard material. Other grips which are comprised of leather, simulated leather, rubber, rubber-like compositions or various other resilient or cushioning compositions, will deteriorate and do not convey the desired feel and sound.

It is preferred that the shaft extend substantially through or along the grip, say, to at least within ⅜" of the end of the grip. In some embodiments, as discussed herein, the shaft may extend the full length of the grip.

The face of the preferred embodiment of the putter is generally flat, with rounding at the corners and edges.

In one embodiment, the face of the putter is designed with a compound surface to correct for hitting the ball too far toward the toe or too far toward the heel of the putter. Such correction includes both correction of direction and correction of distance. The open heel and closed toe correct for direction when a missed hit, or hit outside the "sweet spot", occurs.

Loft, or slant angle of the face of a golf iron, determines the lift given to the ball. Greater loft, or slant angle, for the vertical, given more lift to the ball and increases its roll.

It is, therefore, an object of this invention to provide a putter which has a grip, shaft and head which are an integral, structural unit from the golfer's hands to the "sweet spot".

Another object of this invention is to provide a putter whose grip, shaft and head are comprised of the same or similar materials having closely-related moduli of elasticity.

Still another object of this invention is to provide a putter which provides a solid "feel" of the strike to the golfer' hands.

A still further object of this invention is to provide a putter which provides a low frequency sound when a correct strike occurs.

Still another object of this invention is to provide a putter having a compound face tending to correct inaccuracies of the putting stroke.

A further object of this invention is to provide a putter which is stiff and does not mask, dampen or distort the strike of the ball.

Further objects and features of the invention will become apparent from the following drawings and description.

DESCRIPTION

Figure 1:
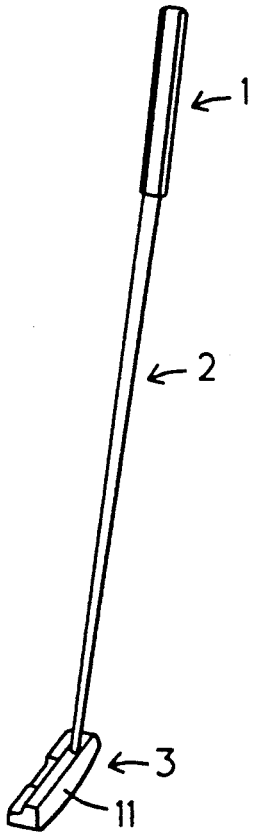
FIG. 1 is a putter, showing grip, shaft and head.

In FIG. 1 is shown a putter comprised of a grip 1, a shaft 2 and head 3. The putter may be welded, cast or forged or otherwise manufactured, but its parts are preferably made of the same material, which may be pure, alloy or other mixtures or compounds. It is desired to have the shaft measure a stiffness of approximately 7 or greater on the Fuji Kura golf shaft frequency analyzer. The entire club has such stiffness or greater. Stiffnesses to approximately 9 have been obtained. This is substantially stiffer than prior putters which usually measure below 6.

The putter may be manufactured in two or more pieces which are then fused, welded, soldered, brazed, sweated or otherwise bonded. All of such methods are termed "bonded" or "bonding". The parts of the putter may also be connected by a pin ("pinned") or by a keyway in one or both parts, with a key tightly inserted, to fix the parts firmly together. In pinning, a hole is drilled through the shaft and through the head or in the grip, as the case may be. A pin, having an interference fit to the drilled hole, is then driven through the head or grip and through the shaft. Grinding and polishing the pin to the surface of the putter then provides a smooth surface in which the pin is hard to detect. An interference fit, which is also termed a friction fit, or a force fit, may be used to attach the shaft to the head or to the grip.

Whatever form of attachment is used, one must be careful not to distort the structural shape of the shaft. An interference fit of the shaft to the putter head, may be completed or strengthened by a plug driven into the shaft from the bottom of the head, after the shaft is inserted in the head. The same is true of the fit to the grip, wherein a plug may be inserted into the shaft through the top of a grip, to complete or strengthen the interference fit of the shaft to the grip. This, in effect, is swaging. Swaging is, therefore, suitable as a means of fixing the shaft to the head or the grip. Clamping, particularly of the grip to the shaft, has also been found suitable.

A stiff, True Temper shaft of low carbon steel having an outer diameter of 0.390" has been found suitable for bonding to a grip and a head. Such company's address is, True Temper Sports Division, 871 Ridgeway Loop Road, Suite 201, Memphis, Ten. 38120-4066. There is a wide range of sources for golf shafts. These sources are known to those skilled in the art of making golf clubs. Such shafts are ordinarily hollow.

The invention is a "unitary" putter that has no "discontinuities" from the head through the shaft to the grip, to the golfer's hands, which "discontinuities" would otherwise cause dissimilar vibration or frequency transition points. In this way, the "strike" of the ball is not damped or distorted and a sensitive, solid "feel" is achieved. It has been found that closing the ends of the shaft, with plugs, provides a lot more feeling in the hands and reduces the high harmonics. Also, it enhances the low frequency sounds.

Various coatings or surface treatment of the grip, the shaft or the head may be applied, such as, but not limited to, chrome, anodize, hardening, knurling, bead blasting, groove-cutting, sanding, etching or other coating or surface treatment which does not interfere with the structural integrity of the putter. The thickness of such coating or surface treatment should be maintained small enough so as not to interfere with the "feel" or the stiffness of the putter.

Plating the entire club provides a better "feel" and helps to remove high frequencies which are not desired to be heard or felt.

The shaft of the putter, when made of a low carbon steel, is preferably about 0.4" outer diameter at its lower end, where it is attached to the head. In one embodiment, the hole in the head, which receives the shaft, is manufactured by drilling to 0.369" and reaming to 0.371" outer diameter. A shaft of 0.370 is then inserted and may be held by interference fit. Any other method of firmly fixing the shaft 2 and the head 3 together, may be used such as, but not limited to, welding, brazing, soldering, fusing, pinning or keying or otherwise rigidly attaching the head and the grip. The shaft outer diameter may increase to approximately 0.6" at the grip end. Care must be taken not to disfigure or distort the shape of the shaft, otherwise its structural integrity will not be retained.

The shaft wall thickness is approximately 0.03". Of course, it is to be realized that differing materials may have greater or less outer diameter and wall thickness because of the strength and modulus of elasticity of the particular material or materials used. The desired stiff "feel" of the putter requires a greater outer diameter or wall thickness, if the modulus of elasticity is less and less outer diameter and wall thickness, if the modulus of elasticity is greater.

Fluted shafts, or shafts having fluted portions may be used, inasmuch as the fluted portions are 10–15% stronger than unfluted portions. Therefore, fluted shafts may be somewhat smaller than unfluted shafts in outer diameter and wall thickness. Malleable cast iron, annealed ingot iron, and commercial wrought iron may be used because they have a modulus of elasticity fairly close to that of low carbon steels. Alloy steels, including nickel steel, chrome-nickel, chrome-vanadium, polybdenum and others, may be used provided their modulus of elasticity is approximately the same or greater than that of the low carbon steels. The strength and stiffness of such alloy steels and other alloys are often determined by their heat treatment rather than their composition.

The putter has a balance point within approximately 3 inches of midway between the top and bottom ends of the putter. This is achieved mostly by increasing or decreasing the grip size and length. This helps to provide a solid feeling of the putter when striking the ball. The putter shaft may be, for example, 35" long and the balance point would be approximately 17.5" from either end.

Figure 2:
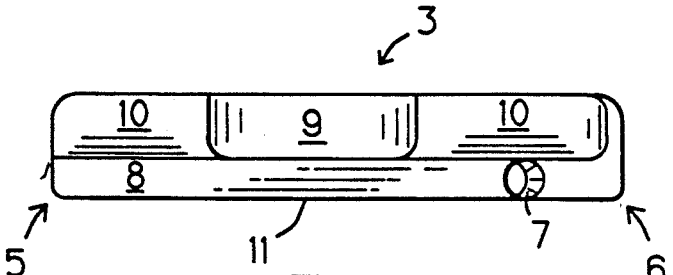
FIG. 2 is a top view of the putter head, showing the hole in the head to receive the putter shaft.

FIG. 2 is a top view of the head of the preferred embodiment of the putter. Putters of the invention are approximately 4.25" to 5.25" in length. The head illustrated is approximately 4.8" in length and approximately 0.7" high and 0.8" deep. FIG. 2 shows shaft hole 7 in the top surface 8 of the head 3. The top surface 8 may be approximately 0.4" wide. If, then, the hole for the shaft is 0.37", there is approximately a 0.015" wall on each side of the hole 7, if it is centered in the top surface 8. Other constructions are possible, but those dimensions are preferred. For example, hole 7 may be as wide or wider than top surface 8. Hole 7 may be located a bit to the rear of top surface 8 and, thus, not centered, in top surface 8. That is not as aesthetically pleasing but, nevertheless, would be functionally suitable. The hole should not extend into the front face 11 of the putter head 3. Cavity 9 is disposed in valley 10 of the head. Cavity 9 provides a sound chamber which adds to the "feel" and sound of the putter.

Figure 2A:
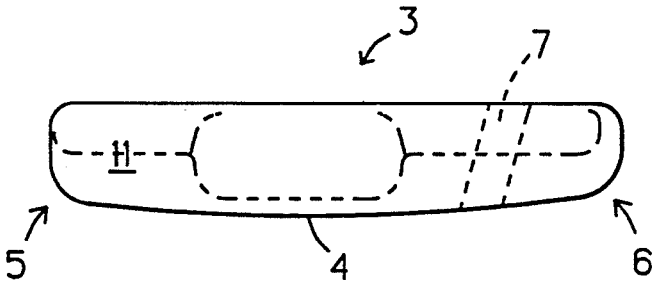
FIG. 2A is a front view of the putter head, showing the striking face.

FIG. 2A is a view of the striking face 11 of the putter head 3. The striking face 11 may also be seen in FIG. 1. In the preferred embodiment, as shown in FIG. 2A, the face 11 is flat with rounded corners and edges as shown. The face 11 has a loft, or backward slant, of approximately 2° degrees to 4° degrees, depending on the golfer's preference. The toe 5 and heel 6 are rounded. The foot 4, where the putter head meets the grass, is rounded to approximately ¼" radius to prevent the head from "sticking" or digging into the grass or ground. The foot 4 is an arc from toe 5 to heel 6 having approximately a 20" radius.

Figure 2B:
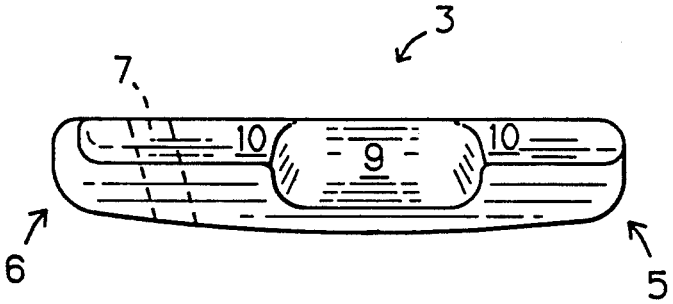
FIG. 2B is a rear view of the putter head.

FIG. 2B is a rear view of the head of the putter, showing valley 10 and sound chamber, cavity 9.

Figure 3:
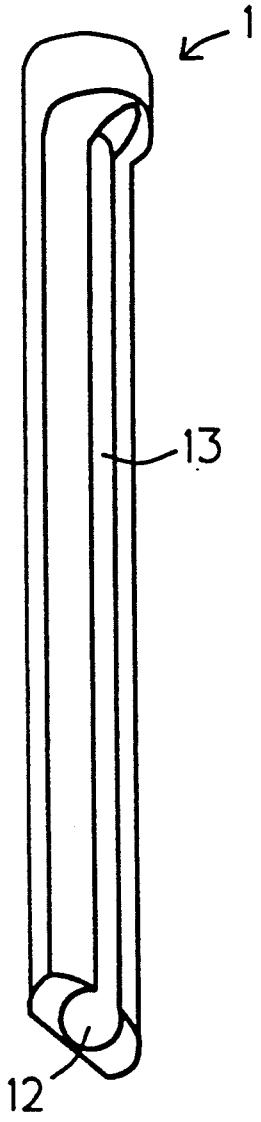
FIG. 3 is a perspective of one embodiment of the grip.
Figure 4:
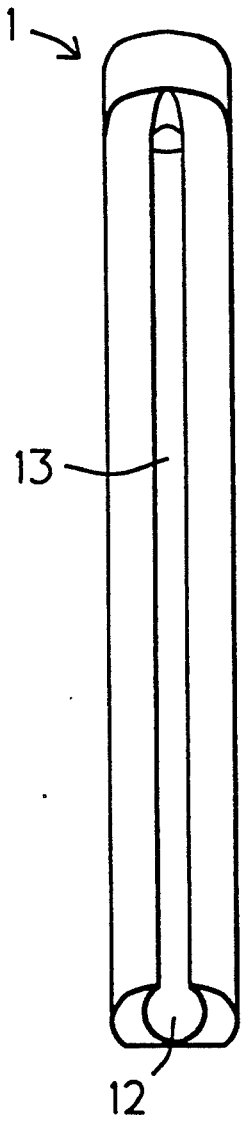
FIG. 4 is a rear view of the grip of FIG. 3.

FIGS. 3 and 4 illustrate one embodiment of the grip 1 which fits over the end of the putter shaft 2. The grip 1 has a flat front face, not shown, but is generally of an oval or, sometimes, circular, shape to fit well into the hands of the golfer. A hole 12 receives the shaft, which extends to the end, or near the end, of the grip 1. Slot 13 permits a direct "feel" of the putter shaft, adding to the sensitivity.

Figure 5:
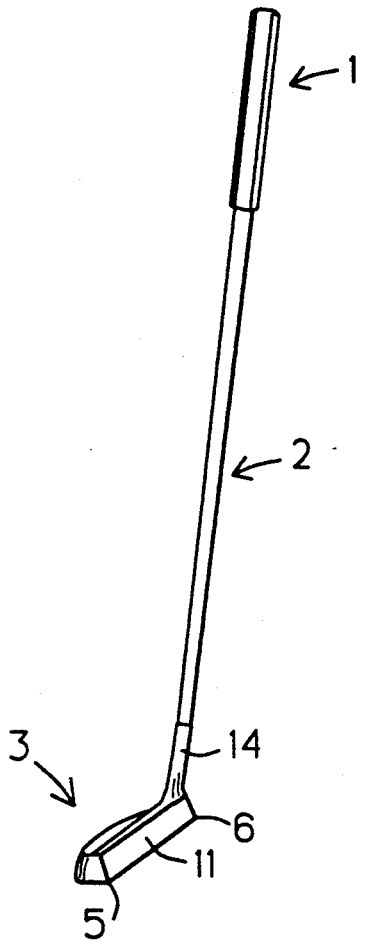
FIG. 5 is a putter, showing grip, shaft and a head having a hosel into which the shaft fits.

FIG. 5 is a putter in which the head 3 has a hosel 14 into which the shaft 2 is inserted. The hosel 14 may take various shapes as presently known in the putter art, to place the shaft forward toward the toe 5 of the head 3 or backward toward the heel 6 of the head 3, or in front of or to the rear of the face 11 of the head 3.

Figure 6:
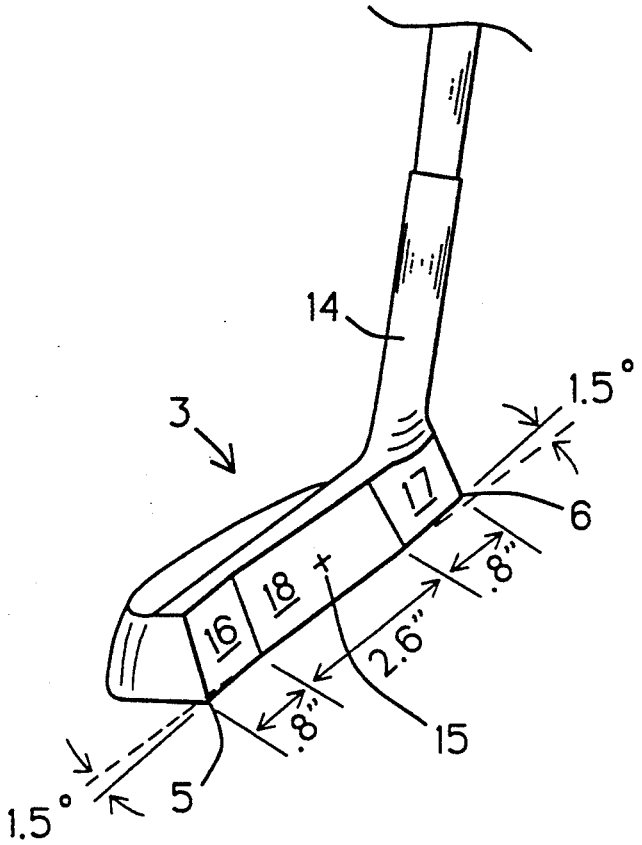
FIG. 6 shows a putter head, illustrating the "sweet spot", the closed toe and the open heel.

FIG. 6 shows a putter head 3, illustrating the "sweet spot" 15. The "sweet spot" area is approximately 2.6" in length which is approximately one and one half times the diameter of a golf ball. In the embodiment shown, the face 11 is a compound surface to compensate for hits outside the "sweet spot" area, toward the toe 5 or toward the heel 6.

A hit that is too far toward the toe of the putter will tend to slice, left to right. Also, the hit will go shorter than intended. To compensate for this, the putter has a closed toe area 16 with a greater loft. Similarly, a hit that is too far toward the heel will tend to hook right to left and go farther than intended. To compensate for this, the putter has an open heel 17 with a lesser loft. The toe area 16 is closed approximately 1.5° degrees and the heel area is open 1.5° degrees. The closed toe area 16 is approximately 0.8" in length, as is the length of the open heel area. In one embodiment, a precise measurement of 0.740±"0.005" was used as the length of each of the closed toe and open heel areas.

Figure 7:
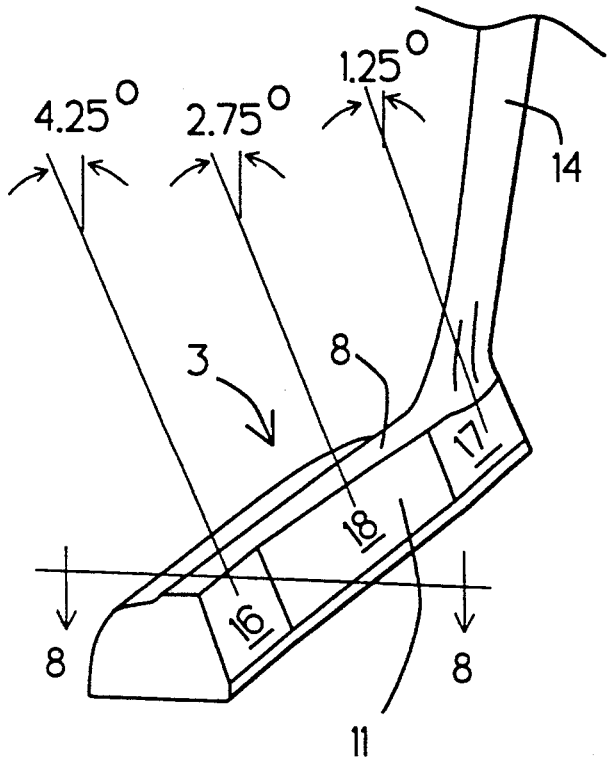
FIG. 7 shows the three areas of the face of the putter, the toe, the "sweet spot" area and the heel, and their loft angles.

FIG. 7 illustrates flat face 11 having a closed toe area 16, open heel area 17 and "sweet spot" area 18, which have differing loft angles of 4.25 degrees, 1.2° degrees and 2.75° degrees, respectively. In putting, a heel hit is likely to go too far and so, a lesser loft angle of 1.25° degrees in the heel, shortens the distance of travel of a heel hit. Similarly, a toe hit does not travel far enough. Therefore, a greater loft angle of 4.25° degrees in the toe lengthens the distance of travel of a toe hit. Other loft angles may be selected, if a golfer so desires.

Figure 8:
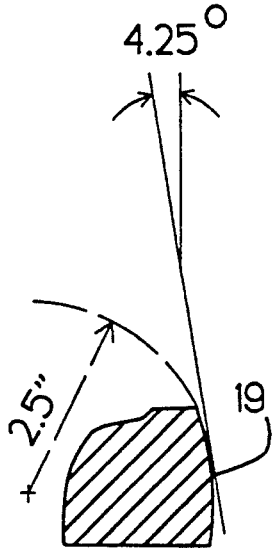
FIG. 8 is a cross-section of the putter head taken on line 8-in FIG. 7.

FIG. 8 is a cross-section taken on line 8—8 in FIG. 7, showing a bulge 19 in the face of the putter. The bulge has a radius of 2.5" Such bulge, together with the loft angle, causes the golf ball to have a backspin, if the ball is struck above the bulge in a downward motion. It is preferred that "sweet spot" area 18 not have a bulge, but that it be flat, enough though closed toe area 16 and open heel area 17 may have bulges. Closed toe area 16 and open heel area 17 may also be made without bulges.

The compound face of the putter, comprising the open heel 17 and closed toe 16 and the differing loft, or slant, angles of toe and heel correct for both direction and distance of hits outside the "sweet spot" area 18 of the putter.

Notwithstanding FIGS. 7 and 8, the preferred embodiment is a putter face that is flat and has a uniform loft, as illustrated in FIGS. 1, 2 and 2A.

Figure 9:
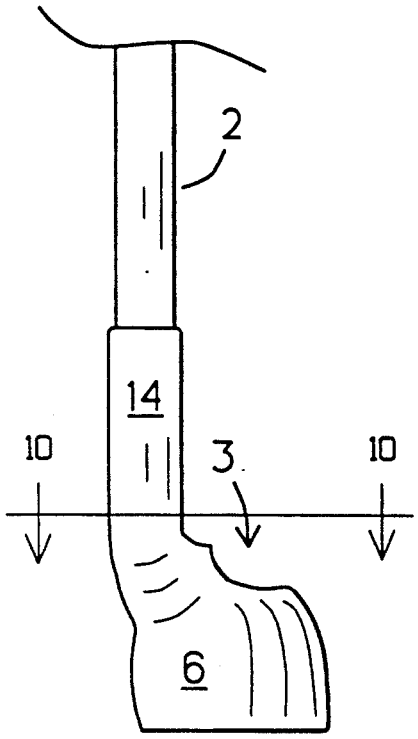
FIG. 9 is a view from the heel of a putter in which the head has a hosel into which the shaft fits.

FIG. 9 is a view of the putter head 3 from the heel 6. The embodiment shown has a hosel 14 which may be seen to place the shaft 2 ahead of, or at least forward to the face of the head 3. Numerous hosel shapes are available, placing the shaft wherever desired. Further, it is to be appreciated, if the shaft enters a putter head, having an hosel, as shown in FIG. 1, the putter shaft 2 may be curved at or near its entrance into the putter head 3 so as to place shaft 2 wherever it is desired.

Figure 10:
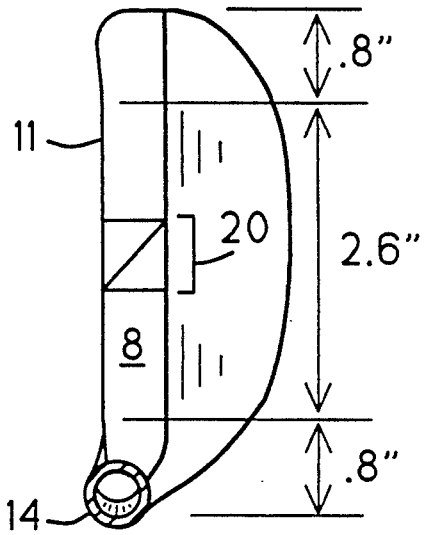
FIG. 10 show a putter head having a hosel and, also, having sight alignment markings, which assist in hitting the ball at an optimum area within the "sweet spot" area.

FIG. 10 is a top view taken on line 10—10 of FIG. 9, showing the hosel 14 and top surface 8. In this embodiment, there is a "Z" alignment marking 20 in the top surface 8. The "Z" is centered above the "sweet spot". The "Z" may be made in the top surface 8, by milling the lines 0.016" deep and 0.060" to 0.080" wide. The letter "Z" may be about 0.56" from top to bottom, which is ⅓ of the diameter of a golf ball, to help the golfer hit right on the "sweet spot" or nearly so. This dimension, of the "Z" being ⅓ of the diameter of the golf ball allows quicker sighting of where to hit, leaving ⅓ of the golf ball on each side of the "Z". Actually, a hit within plus or minus 0.4" (0.8" wide) of the "sweet spot" is a good hit.

A particular feature may be built into the alignment marking 10. In some embodiments, top surface 8 slopes downwardly to the rear of the putter head 3 at an angle of approximately 30° degrees. The two lines of the "Z" which are perpendicular to the face 11 likewise slant 30° degrees to the rear. The intermediate line connecting them likewise slants downwardly to the rear at 30° degrees. Still another embodiment, in which the top surface 8 is horizontal, but the "Z" is constructed to slope downwardly to the rear at an angle of 30° degrees. The middle leg of the "Z" however, has one or more steps down in its construction.

If a golfer turns his head even so slightly, the line from one eye to another will be more nearly parallel to the slanted "Z" alignment marking 20. Because the alignment system is so constructed, it functions equally well for the golfer, irrespective of whether he is right-eye or left-eye dominant, In the putter of the invention, if the ball is hit toward the heel or toward the toe, from the "sweet spot", a different tone and different vibrational "feel" is generated, depending on how far from the "sweet spot" the hit is made. This helps the golfer to develop his form so as to habitually hit the ball on or near the "sweet spot".

Figure 11C:
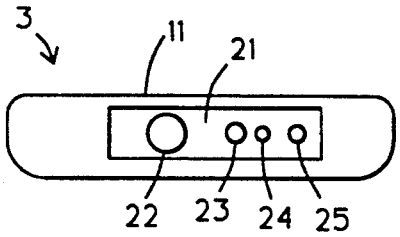
FIG. 11C is a bottom view of the putter head of FIG. 11, in which the resonating elements within the sound chamber are round.
Figure 11D:
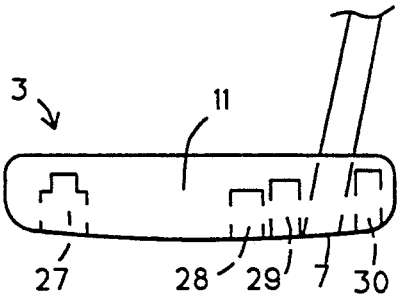
FIG. 11D is front view of the putter head having bores and counterbores, shown by hidden lines, as resonating chambers.
Figure 11B:
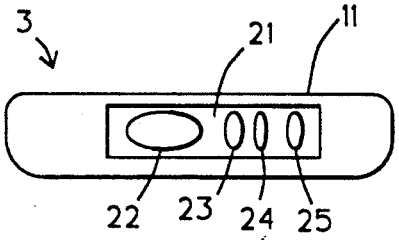
FIG. 11B is a bottom view of the putter head of FIG. 11, in which the resonating elements within the sound chamber are elliptical.
Figure 11E:
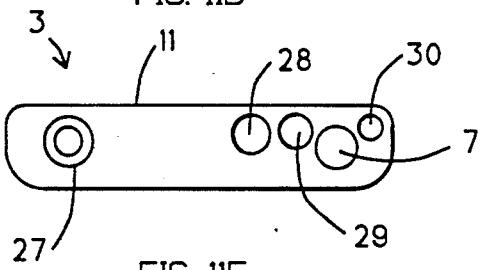
FIG. 11E is a bottom view of the putter head of FIG. 11D, showing the bores and counterbores, as resonating chambers.
Figure 11A:
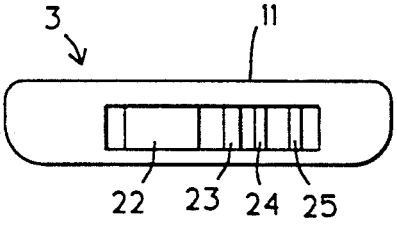
FIG. 11A is a bottom view of the putter head of FIG. 11, in which the resonating elements within the sound chamber are elliptical.
Figure 11F:
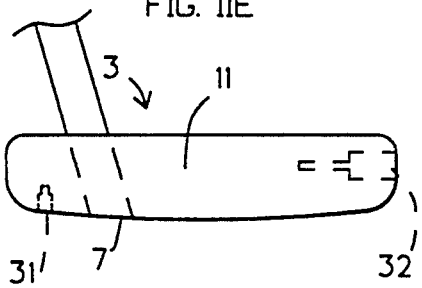
FIG. 11F is a front view of a left-handed putter head having a counterbore in end of the toe and a counterbore in the heel.
Figure 11:
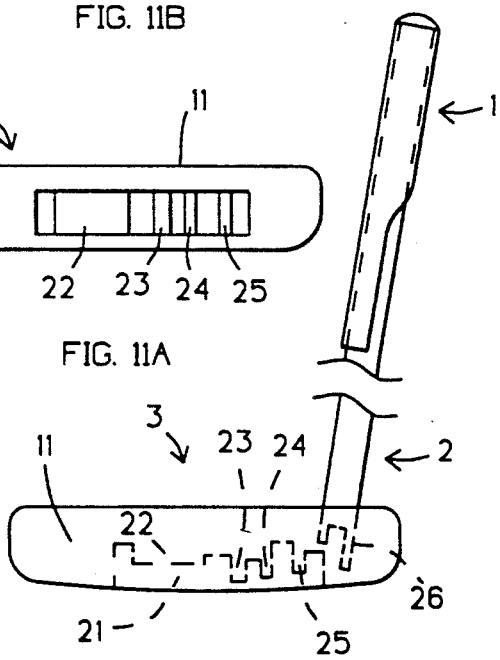
FIG. 11 is a front view of the putter head having a sound chamber with resonating elements, shown by hidden lines, therein.

FIG. 11 is a putter of the invention, in which putter head 3 has a sound chamber 21 having resonating elements 22, 23, 24 and 25 therein. The shaft 2 terminates in a fork 26 which may be open or filled with material which may or may not be consistent in modulus of elasticity with the remainder of the putter head 3. Lead has been found to provide a good filler.

The particular vibrational and tonal properties created by constructing the putter with resonating elements, as described herein, is termed by me, as "Quadratic Fusion". A hypersensitive golf club is thus achieved, providing both feeling and sound to the golfer.

As previously noted, closing both ends of shaft 2 provides a sound chamber within the shaft which enhances the low frequency "feel" and sound.

FIGS. 11A, B, and C are bottom views of the putter head 3 of FIG. 11, showing resonating elements of rectangular, elliptical and round construction. FIG. 11A shows bridge type resonating elements 22, 23, 24 and 25. Such bridge type resonating elements extend all the way across the resonating chamber. On the other hand, such resonating elements may be disconnected from the walls of the chamber, and still be of rectangular shape. FIG. 11B shows elliptical resonating elements 22, 23, 24 and 25. FIG. 11C shows circular resonating elements 22, 23, 24 and 25. It may be seen that the resonating elements 22, 23, 24 and 25 of FIGS. 11B and 11C are formed as columns within the resonating chamber 21. These embodiments are formed by milling or cutting the underside of the putter head 3.

FIG. 11D is a front view of the face 11 of the putter head 3, showing, by hidden lines, another manner of making the resonating elements. Counterbore 27 provides a resonating element of differing depths and resonances. Bores 28, 29 and 30 by reason of their differing lengths and diameters also provide resonating elements of varying depths and resonances.

FIG. 11E is a bottom view of FIG. 11D and more clearly illustrates the counterbore 27 and bores 28, 29 and 30. It may be understood that the resonating bores and counterbores may be disposed at other locations within the putter head 3, with openings to the bottom of the putter head 3. Other lengths and diameters may be generated besides those shown. It has been found that resonances may still be obtained after filling such bores and counterbores with various materialism, including materials as dense as lead.

FIG. 11F illustrates a left-handed putter head having a counterbore disposed horizontally in the toe and a vertical counter bore in the heel, having small radial dimensions. Counterbore 32, in the toe, may be approximately ¼" diameter to a depth of ⅜" and then a 3/32" diameter an additional depth of ½". Counterbore 31 may be a diameter of ½" to a depth of 0.2" and then 1/16" diameter an additional depth of 0.1".

Figure 11G:
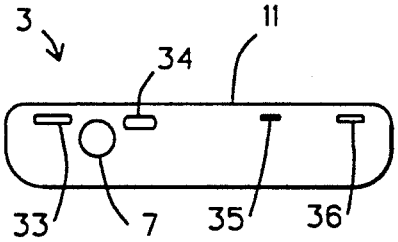
FIG. 11G is a bottom view of the left-handed putter head, showing resonating slots.

FIG. 11G illustrates the bottom of a left-handed putter head having resonating slots 33, 34, 35 and 36. Suitable dimensions for such slots are as follows: for slot 33, the slot is approximately ⅜" wide, ⅜" deep and ½" long; for slot 34, the slot is approximately ⅜" wide, ⅜" deep and ¼" long; for slot 35, the slot is approximately 3/32" wide, 3/32" deep and ¼" long; and for slot 36, the slot is approximately ⅛" wide, ⅛" long and ⅜" long.

The counterbores and slots are generally kept clear of the portion of the "sweet spot area" plus or minus approximately 0.4" from the "sweet spot". Also, counterbores and slots are placed at least approximately 0.13" back from face 11.

It has been found that such constructions provide a dissipation of the high frequencies feel and sound and enhance or retain the low frequencies feel and sound.

While the putter head, shaft or grip may include materials of lower modulus of elasticity, as explained with respect to using lead, filling the bores 28, 29 and 30, there must be no material with a modulus of elasticity substantially lower than malleable cast iron, in the structural connection between the "sweet spot" and the golfer's grip.

A putter made in accordance with the invention, using the sound chamber, resonating elements, or one of the variations thereof, will provide the golfer an amplified, low frequency sound and "feel" when he hits the ball correctly. A bad hit will provide a high frequency feel and sound of 8000 cycles per minute and up. When the ball is hit within the "sweet spot area" of approximately 2.5" in length, the low frequency sound and "feel" originate in the unitary construction of the putter and are maintained and amplified by the resonating elements, sound chamber and the shaft with closed ends.

FIGS. 12 to 20 illustrate various shapes of grips. Although the various shafts 2 are shown as extending to the ends of the grips 1, the shafts 2 may terminate short of the end of the grips 1. As may be seen there is no intervening material between the shaft and the grips. If a connecting or bonding material is used, it must be consistent with the shaft and grip in modulus of elasticity in order to preserve the sound of the putter and the "feel" of the putter and to convey the vibrations to the hands of the golfer. Resilient adhesives and epoxys or other flexible or resilient materials are shunned because they will reduce or modify the "feel" and sound of the putter.

Figure 12:
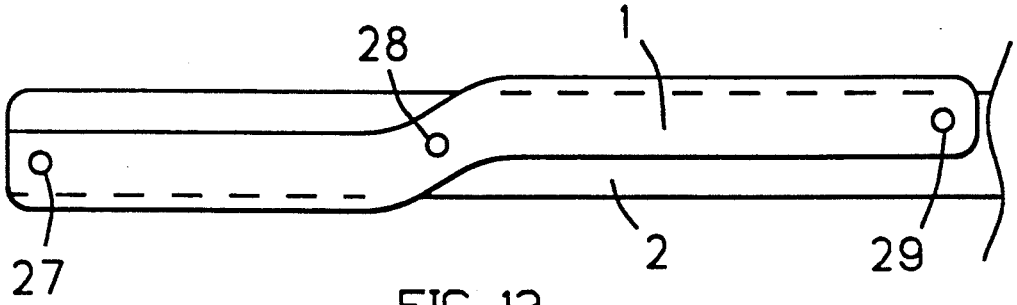
FIGS. 12 through 20 illustrate the shapes of various grips of the putter.
Figure 13:
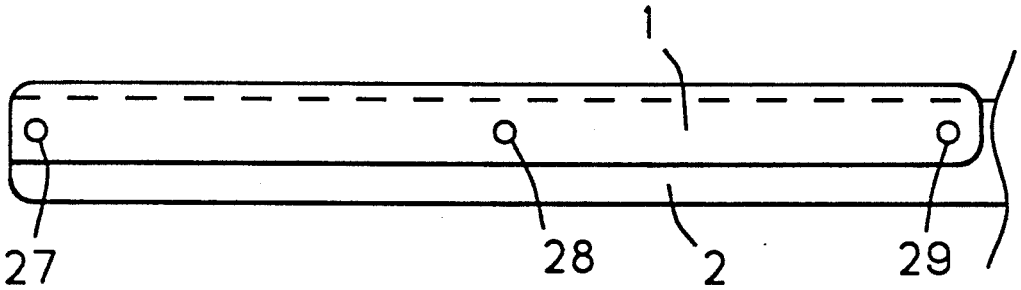
Figure 14:
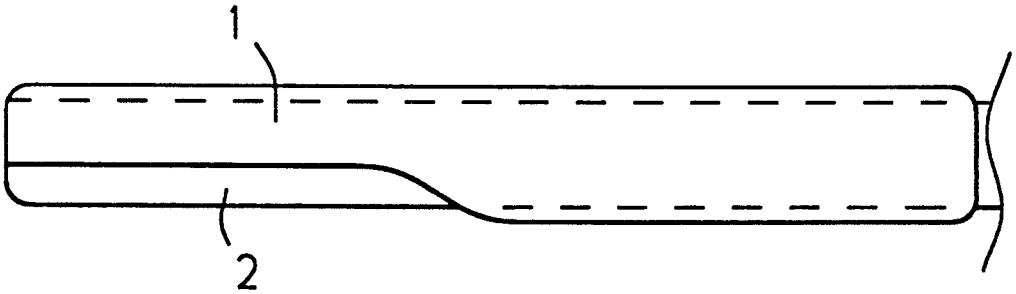
Figure 15:
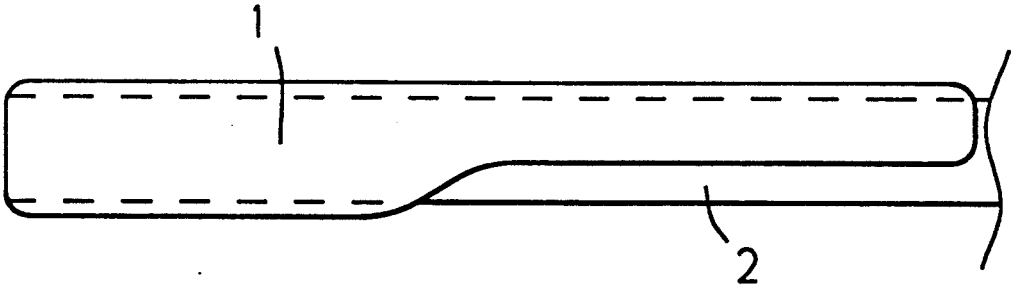
Figure 16:
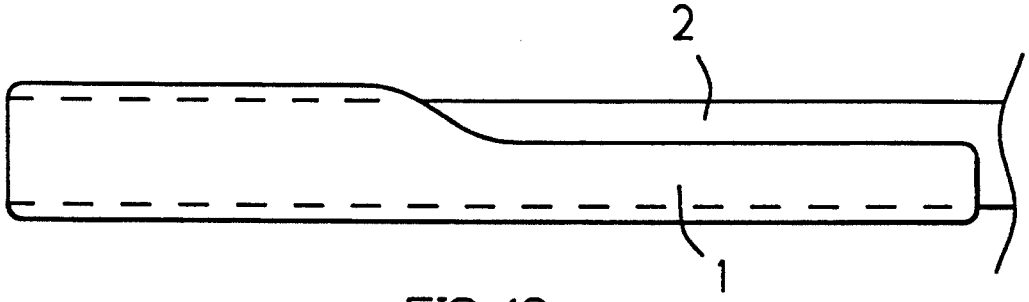
Figure 17:
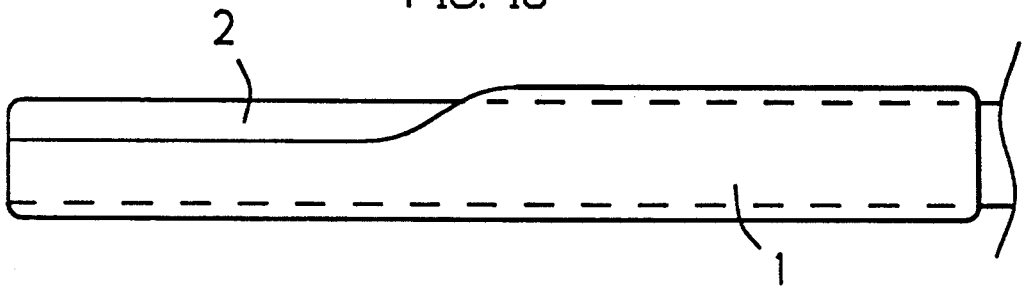
Figure 18:
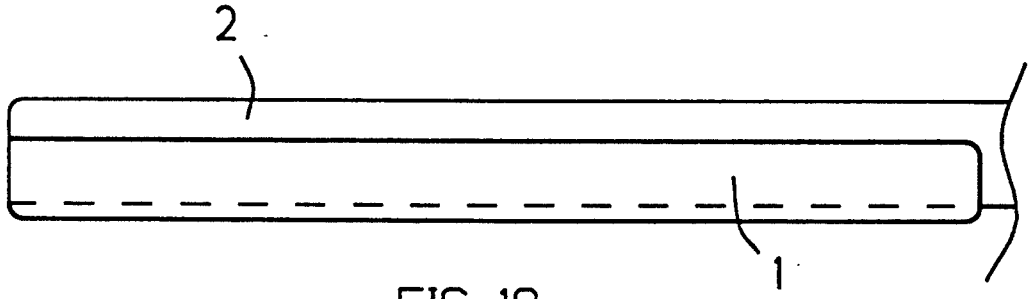
Figure 19:
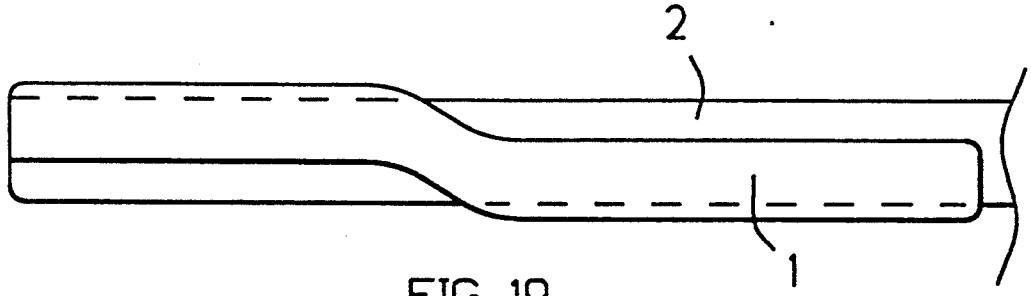
Figure 20:
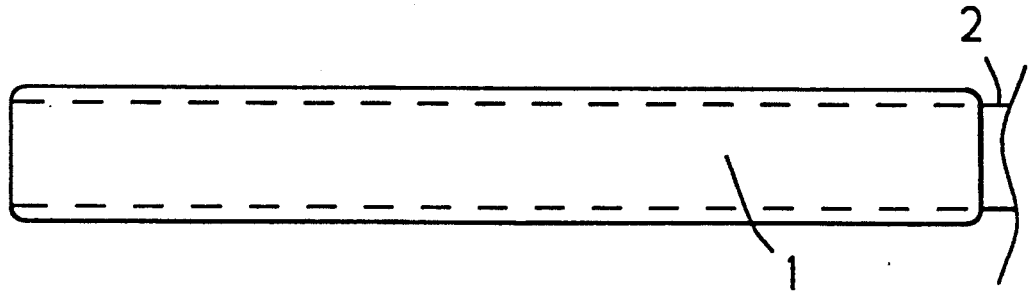

The grip 1 and the shaft 2 may be attached to each other by the means previously mentioned. FIGS. 12 and 13 illustrate the use of pins 27, 28 and 29 to hold the grips 1 to the shafts 2. The pins, of course, may be ground flush with the grip and polished so as to be invisible.

Pins (not shown) may similarly be used to connect the shaft 2 to the putter head 3, FIG. 1, or hosel 14, FIG. 6.

A putter constructed as set forth herein has been found, when the ball is hit fairly correctly and within the "sweet spot area", to provide the golfer with a low frequency "feel" having a vibrational intensity several times that of prior putters. The low frequency sound generated is also twice or more as great as any of such prior putters. The tone generated may be adjusted from approximately 800 to 2300 cycles per minute by adjustment of the resonating elements and the sound chamber.

Although specific embodiments and certain arrangements have been illustrated and described herein, it will be clear to those skilled in the art that various modifications and embodiments may be made incorporating the spirit and scope of the underlying inventive concepts and that the same are not limited to the particular examples herein shown and described except insofar as indicated by the scope of the appended claims.

I claim:

1. A golf putter adapted for striking a golf ball, said putter comprising a grip, a shaft and a head, said shaft having opposite ends, said grip attached to one of said ends and said head attached to the other of said ends, and wherein said grip is constructed throughout of one or more materials having a modulus of elasticity substantially greater than 2,000,000 psi, and wherein said grip has an end nearest said head and a distal end farthest from said head, and wherein said shaft extends substantially length of said grip to within approximately ⅜" of the distal end of said grip.

2. A golf putter adapted for striking a golf ball, said putter comprising a grip, a shaft and a head, said shaft having opposite ends, said grip attached to one of said ends and said head attached to the other of said ends, and wherein said grip is constructed throughout of one or more materials having a modulus of elasticity substantially greater than 2,000,000 psi, and wherein said shaft extends within said grip substantially throughout the length of said grip.

3. A golf putter comprising a grip, shaft and head, said shaft having opposite ends, said grip attached to one of said ends and said head attached to the other of said ends, and said shaft being connected to said grip without any intervening material having a modulus of elasticity substantially less than the modulus of elasticity of said shaft and said grip, whichever modulus, is least, and wherein said shaft and said grip consist of one or more materials having a modulus of elasticity substantially greater than 2,000,000 psi in tension, and wherein said head has a face on one side thereof for striking a golf ball, said face having a toe at the far end of said face from said shaft and a heel at the near end of said face from said shaft, wherein said face of said putter has a closed toe and an open heel.

4. The putter of claim 3 wherein one or more of said heel and said toe are open and closed, respectively, at approximately 1.5° degrees.

5. The putter of claim 3 wherein the length along which each of said heel and said toe are open and closed is approximately 0.8 inches.

6. A golf putter comprising a grip, shaft and head, said shaft having opposite ends, said grip attached to one of said ends and said head attached to the other of said ends, and said shaft being connected to said grip without any intervening material having a modulus of elasticity substantially less than the modulus of elasticity of said shaft and said grip, whichever modulus is least, and wherein said shaft and said grip consist of one or more materials having a modulus of elasticity substantially greater than 2,000,000 psi in tension, and wherein said head has a face on one side thereof for striking a golf ball, wherein said face of said head has a "sweet spot" area, a heel area and a toe area and one or both of said heel area and said toe area have a bulge thereon, and said "sweet spot" area has no bulge.

7. A golf putter comprising a grip, shaft and head, said shaft having opposite ends, said grip attached to one of said ends and said head attached to the other of said ends, and said shaft being connected to said grip without any intervening material having a modulus of elasticity substantially less than the modulus of elasticity of said shaft and said grip, whichever modulus is least, and wherein said shaft and said grip consist of one or more materials having a modulus of elasticity substantially greater than 2,000,000 psi in tension, and wherein said head has a face having a "sweet spot" area, a toe area and a heel area, and wherein the face of said head is lofted and said "sweet spot" area has a different loft than one or more of said toe area and said heel area.

8. The putter of claim 7 wherein the loft of said toe area is more than the loft of said "sweet spot" area and the loft of said heel area is less than the loft of said "sweet spot" area.

9. The putter of claim 7 wherein said "sweet spot" area is approximately 2.6 inches in length along the face of said head and said heel area and said toe area are approximately 0.8 inches in length along the face of said head.

10. The putter of claim 7 wherein said loft of said "sweet spot" are is approximately 3° degrees and the loft of said toe area is approximately 4.3° degrees and the loft of said heel area is approximately 1.3° degrees.

11. A golf putter comprising a grip, shaft and head, said shaft having opposite ends, said grip attached to one of said ends and said head attached to the other of said ends, and said shaft being connected to said grip without any intervening material having a modulus of elasticity substantially less than the modulus of elasticity of said shaft and said grip, whichever modulus is least, and wherein said shaft and said grip consist of one or more materials having a modulus of elasticity substantially greater than 2,000,000 psi in tension, and wherein said head has a top surface and a "Z" is inscribed on said top surface, as an alignment marking for the golfer, said "Z" being approximately 0.56" from the top line of the letter "Z" to the bottom line of the letter "Z".

* * * * *